US008584418B2

(12) United States Patent
Underkofler et al.

(10) Patent No.: US 8,584,418 B2
(45) Date of Patent: Nov. 19, 2013

(54) CROSS RUNNER CONNECTOR AND MAIN RUNNER RECEIVING HOLE

(75) Inventors: Abraham M. Underkofler, Waukegan, IL (US); Peder J. Gulbrandsen, Aurora, IL (US); Mark R. Paulsen, Waukegan, IL (US); James J. Lehane, McHenry, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/598,984

(22) Filed: Aug. 30, 2012

(65) Prior Publication Data

US 2013/0061550 A1 Mar. 14, 2013

Related U.S. Application Data

(60) Provisional application No. 61/532,755, filed on Sep. 9, 2011.

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04F 13/08*** | (2006.01) |

(52) U.S. Cl.

CPC ..... *E04F 13/0803* (2013.01)
USPC ..... 52/506.05

(58) Field of Classification Search

USPC ..... 52/505, 506.01, 506.05, 506.06, 52/506.07, 664, 665, 506.02, 506.03, 52/506.04, 506.08, 506.09

See application file for complete search history.

(56) References Cited

U.S. PATENT DOCUMENTS

| | | | | |
|---|---|---|---|---|
| 3,922,829 | A | 12/1975 | Sauer | |
| 4,389,828 | A * | 6/1983 | Cary | 52/665 |
| 5,154,031 | A * | 10/1992 | Wall | 52/506.06 |
| 5,517,796 | A | 5/1996 | Koski et al. | |
| 5,761,868 | A | 6/1998 | LaLonde et al. | |
| 5,839,246 | A * | 11/1998 | Ziegler et al. | 52/506.07 |
| 5,966,887 | A * | 10/1999 | Mieyal | 52/506.07 |
| 6,523,313 | B2 * | 2/2003 | Lin et al. | 52/506.06 |
| 6,729,100 | B2 * | 5/2004 | Koski et al. | 52/506.05 |
| 7,490,446 | B1 * | 2/2009 | Chuang | 52/664 |
| 2004/0159064 | A1 * | 8/2004 | Okumura | 52/506.06 |
| 2005/0166509 | A1 * | 8/2005 | Sareyka et al. | 52/506.07 |
| 2005/0166523 | A1 * | 8/2005 | Platt et al. | 52/633 |
| 2006/0165481 | A1 | 7/2006 | Barbuio | |
| 2011/0239576 | A1 * | 10/2011 | Dallan | 52/506.07 |

OTHER PUBLICATIONS

Notification of Transmittal of The International Search Report and The Written Opinion of the International Searching Authority, or the Declaration, International Search Report dated Mar. 5, 2013, Written Opinion of the International Searching Authority of corresponding International PCT Application No. PCT/US2012/053262, filed Aug. 31, 2012.

* cited by examiner

*Primary Examiner* — William Gilbert
*Assistant Examiner* — Kyle Walraed-Sullivan
(74) *Attorney, Agent, or Firm* — Pearne & Gordon LLP

(57) ABSTRACT

A cross runner connector receivable in a through runner hole that locks with an identical opposed connector and locks with the through runner hole with increased tensile strength, both locks being releasable without tools by manipulation of the associated cross runner.

7 Claims, 3 Drawing Sheets

FIG. 1
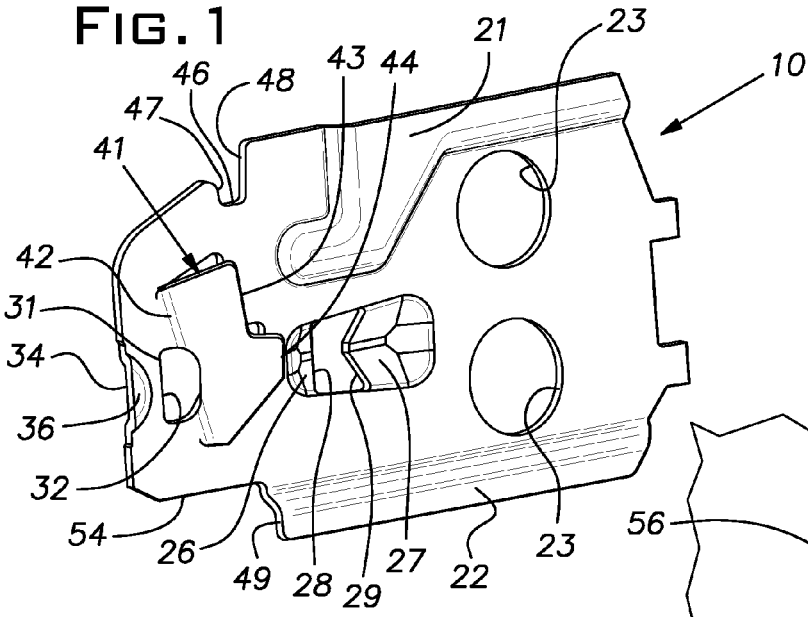
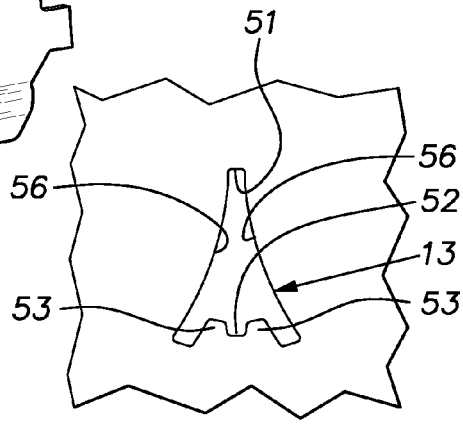
FIG. 2
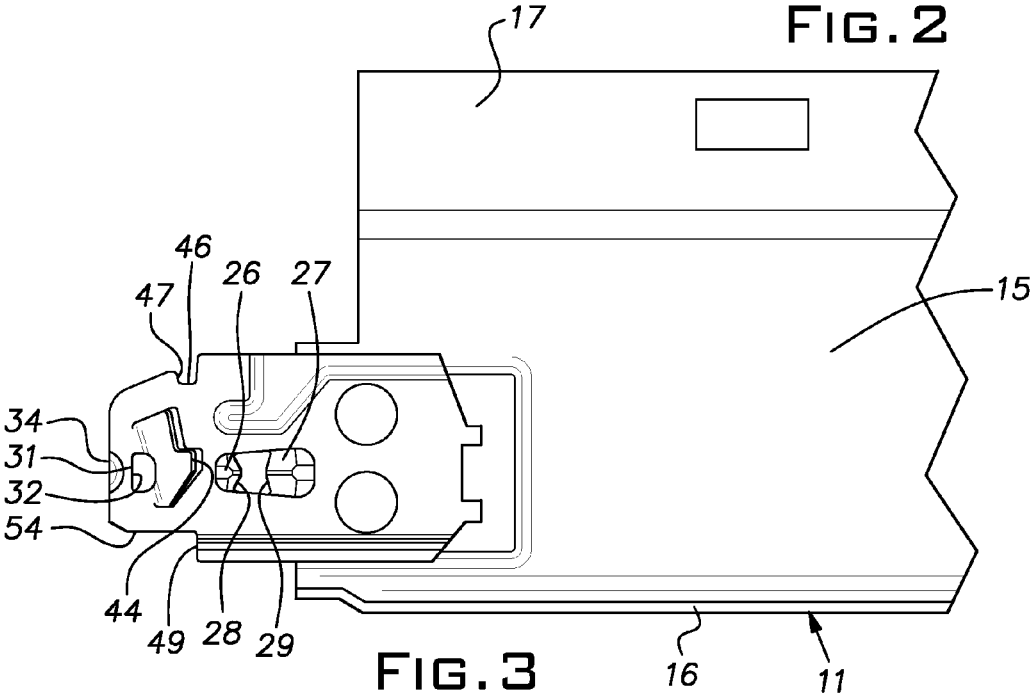
FIG. 3

CROSS RUNNER CONNECTOR AND MAIN RUNNER RECEIVING HOLE

CROSS RUNNER CONNECTOR AND MAIN RUNNER RECEIVING HOLE

This application claims the priority of U.S. Provisional Application No. 61/532,755, filed Sep. 9, 2011.

BACKGROUND OF THE INVENTION

The invention relates to suspended ceiling grid and, more particularly, to cross runner connections.

PRIOR ART

Suspended ceiling grid is typically constructed with main runners that are relatively long and cross runners that intersect the main runners and are relatively short. The main runners are formed with holes along their length strategically spaced to receive connectors on the ends of the cross runners. Typically, the grid runners are referred to as tees because of their most common cross-sectional shape. U.S. Pat. Nos. 5,517,796 and 5,761,868 illustrate examples of cross runner end connectors.

SUMMARY OF THE INVENTION

The invention provides an improved cross runner connector or clip and main tee connector receiving hole. The connector and receiving hole achieve a single runner joint that has a much higher pull out or tensile resistance than prior art systems and can be easily disassembled from either a single or double runner connection.

The invention utilizes a unique locking tab that greatly improves single runner connection performance. The geometry of the inventive tab resists buckling or folding of the tab when the associated runner is subjected to high tensile loads. Additionally, the inventive tab, by virtue of its geometry and spring characteristics reduces free play in a joint. The single connection joint made by the inventive connector is less prone to accidental release in a cantilever condition where only one end of a cross runner is supported.

The geometry of the connector and receiving hole permits the connector to be easily released from either a single connector joint or a connector-to-connector joint. The release can be effected without damage or physical alteration to either the main runner or the cross runner. This non-destructive, non-altering release allows a cross runner to be disassembled and reconnected multiple times without loss of function.

BRIEF DESCRIPTION OF THE DRAWINGS

FIG. 1 is a perspective side view of the connector of the invention;

FIG. 2 is a fragmentary side view of a main or through runner having a connector receiving hole of the invention;

FIG. 3 is a side view of the connector and an end portion of a cross runner;

DESCRIPTION OF THE PREFERRED EMBODIMENT

Figure 4:
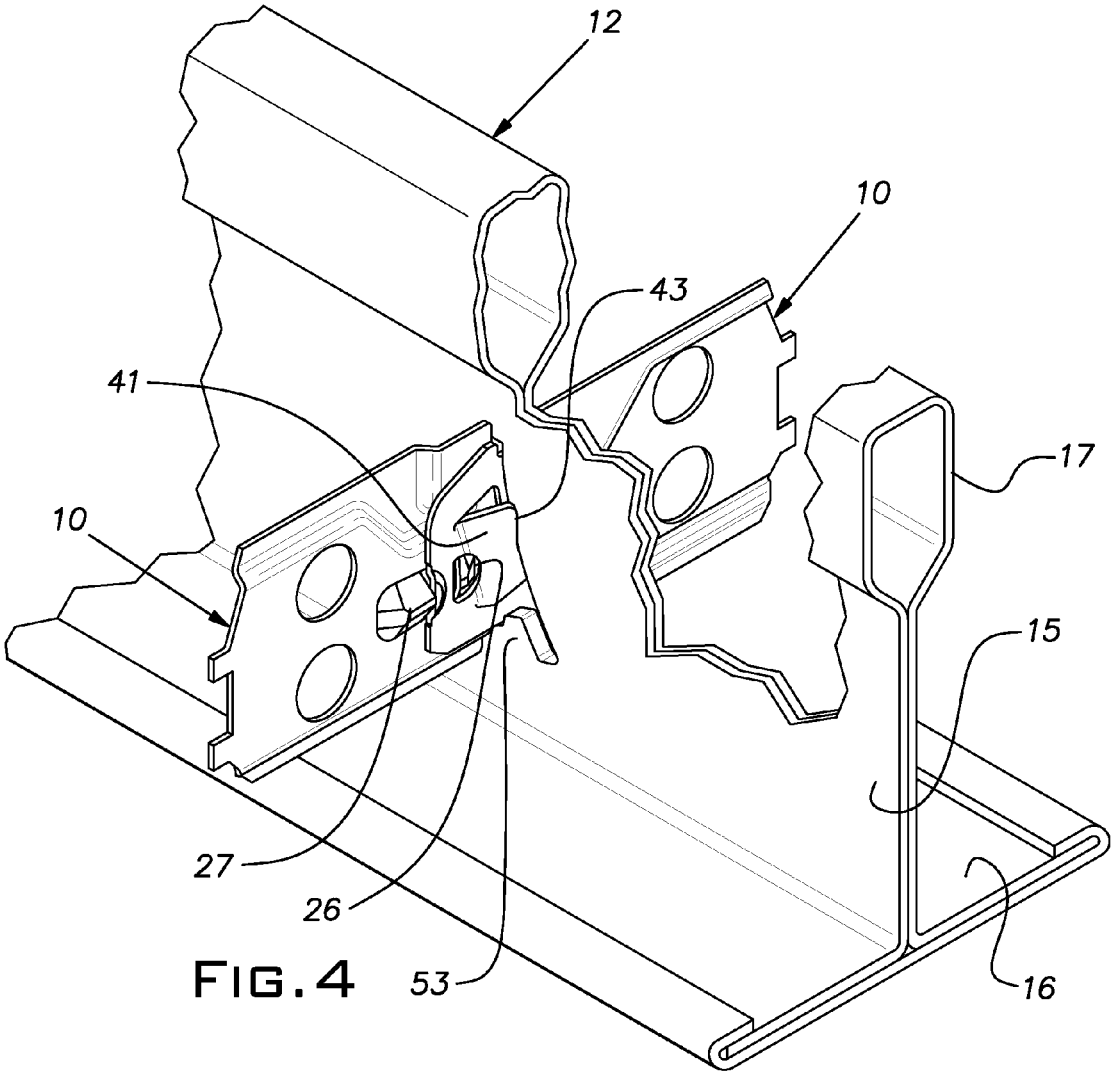
FIG. 4 is a perspective fragmentary view of a pair of opposed connectors assembled in a common hole in a main runner.
Figure 7:
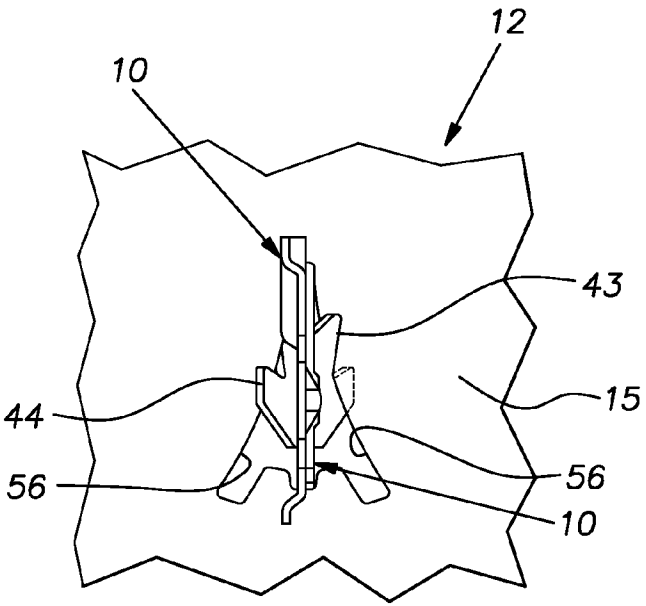
FIG. 7 is an end view of a connector assembled in a main runner hole with an opposed connector.
Figure 6:
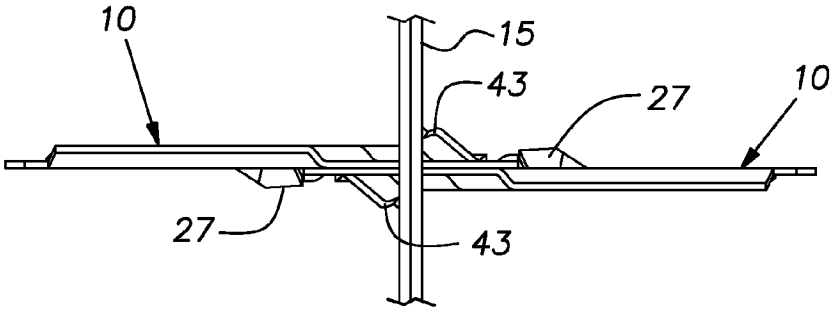
FIG. 6 is a top view of the pair of joined connectors.
Figure 5:
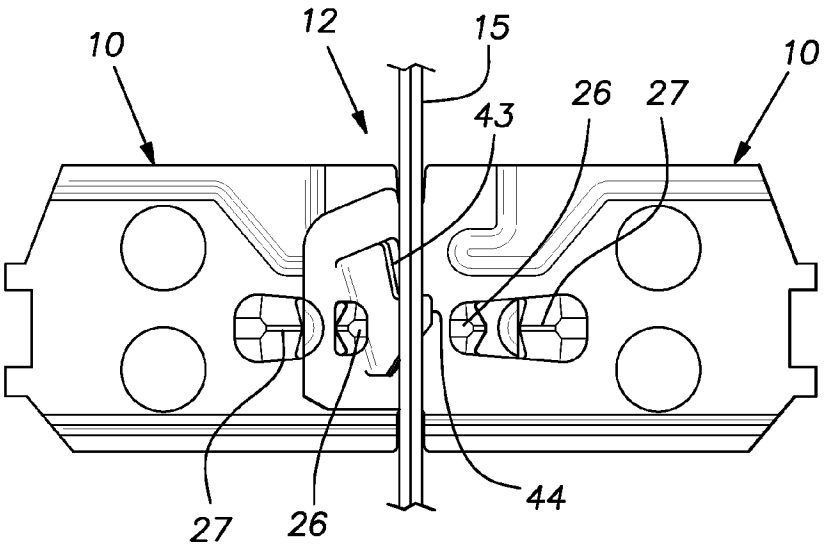
FIG. 5 is a side view of a pair of joined connectors.

A connector or clip 10 of the invention is permanently assembled on an end of a cross runner or tee 11 and is effective to join the cross tee to a main runner or tee 12 at a hole 13 of the invention in the main tee. The connector 10 is also capable of joining with an identical connector of an opposed cross runner or tee 11 inserted in a hole 13 from an opposite side of the main runner 12. As is customary, main runners 12 are arranged on parallel lines spaced apart by a plurality of cross runners 11 spaced along the main runners on centers determined by the location of the holes 13 on the main runners. Typically, the runners 11, 12 are manufactured by roll forming sheet metal into the desired cross section. A cross runner 11 has an identical connector 10 fixed on each of its ends. The connectors or clips 10 are mounted to a web 15 of the cross runner 11 that extends between a lower flange 16 and an upper hollow reinforcing bulb 17. The main runner 12 has holes 13 located along its length spaced at, for example, 6 inches, or the industry metric equivalent thereof, and are used to establish a corresponding grid module of 2 foot or 4 foot. In 2 foot by 2 foot modules, a 4 foot cross runner, as is customary, can serve as a main or through runner for a 2 foot cross runner; a hole 13 is located at the mid-length of the 4 foot through (cross) runner.

The connector 10 is stamped from high strength, hard sheet metal and exhibits spring characteristics. The side profile of the connection 10 is roughly rectangular, having a length greater than its height. Upper and lower margins 21, 22 of the connector 10 are offset from a major central plane of the connector to impart stiffness. Two holes 23 through the body of the connector 10 receive material of a cross runner that is folded or crimped over edges of the holes to fix the connector onto an end of a cross runner 11.

The connector 10 has a pair of opposed projections 26, 27 spaced by an opening that forms edges 28, 29. The projections 26 are arranged to receive a strip or band 31 of material at the leading edge of an identical clip. A D-shaped hole 32 is proportioned to receive a forward projection 26 of a mating connector. Additionally, where the connector 10 is joined to an identical connector, the edge 29 of the rearward projection 27 engages a lead end 34 of the identical clip to resist compressive longitudinal forces in the associated runners 11.

An embossment 36 in the lead or forward end of a connector 10 facilitates coupling of a pair of clips being forced together in a common hole 13, as discussed below, by riding over the forward projection 26 of the opposed connector 10.

A locking tab 41 is stamped and permanently bent out of a main plane of the clip body to a side opposite that on which the projections 26, 27 exist. The tab 41, which in the illustrated arrangement is planar, is attached to the main clip body at a bend line 42 which is inclined forwardly from bottom to top. A generally rearwardly facing free edge of the tab is stepped or offset so that an upper part of the edge 43 lies forward of a lower part 44. The upper part or zone 43 of the edge is inclined forwardly from bottom to top. The connector 10 has a generally vertical notch 46 on its forward upper edge, each side of the notch diverging, for example, at about 5 degrees from the vertical. The lower part 44 of the free edge of the locking tab 41 is rearward of an imaginary vertical plane, transverse to the plane of the main body of the connector 10, that is tangent to a forward edge 47 of the notch 46. A rearward edge 48 of the notch 46 lies generally in a vertical plane transverse to the connector body common with a vertical lower abutment edge 49 of the connector profile.

The cross runner connector receiving hole 13 is stamped in the web 15 of the through or main runner 12. The hole 13 has a shape similar to the capital letter A, being symmetrical about a vertical axis. A narrow top 51 of the hole 13 has a width adequate to receive the thickness of two connectors 10 with moderate clearance. A notch or shallow slot 52 at the bottom of the hole 13, between a pair of abutments 53 is similarly proportioned to receive a double thickness of a connector body with moderate clearance. The distance between the top 51 of the hole 13 and the top of the abutments 53 is greater than the distance between the bottom of a connector notch 46 and a lower edge 54 of a forward end of the connector 10. Opposite sides or edges 56 of the hole 13 are arcuate and convex.

A cross runner or tee 11 is assembled to a main runner or tee 12 by inserting its end connector 10 in an appropriate hole 13. The body of the connector 10 is inserted in the center of the hole 13 so that its lower edge 54 is in the central notch 52. The cross runner 11 is pushed towards the main runner 12 until the connector profile edges 48 and 49 abut the surface of the web 15 surrounding the hole 13. This insertion motion causes the tab 41 to be forced towards the main body of the connector 10 by a camming action developed by interference between the tab and a side 56 of the hole 13. Before the connector edges 48 and 49 contact the web 15, the forwardmost part of the first tab edge 43 will reach the far side of the web 15 and the tab 41 will spring towards its free state. This spring action drives the forward part of the edge 47 outward of the boundary of the adjacent side 56 of the hole 13 thereby locking the connector 10 in the hole. The tab 41 is proportioned so that its trailing part behind the forward edge 43 and including the rearward edge 44 cannot pass through the hole 13 before motion of the connection is stopped by abutment of the edges 48 and 49 with the main runner web 15. The resilient spring action of the tab 41 causes the slightly inclined forward edge 43 at the free edge of the tab 41 working against the convex hole side 56 to draw the connector 10 tight against the main runner 12.

The distal trailing part of the tab 41, since it cannot pass through the hole 13 and is laterally confined by the hole prevents the tab from buckling or folding outward, i.e. over-bending from the main body of the connector 10 when even a high tensile load is applied to the associated cross runner 11. The connector 10 has demonstrated a resistance to such tensile loads of 5 or more times than that of currently available prior art products.

Circumstances occur where the opposite end of a cross runner 11 is unsupported so that the cross runner is in a cantilever condition. This condition can occur, for example, where an opposite end was improperly or not fully installed on a parallel main tee and then falls off the parallel main tee. Another circumstance occurs where an installer inserts a connector 10 in a main runner hole 13 and allows the cross runner to hang with its opposite end temporarily unsupported during erection of a grid. In these circumstances, the notch 46 serves to cooperate with the locking tab 41 to maintain the joint or coupling of the cross runner with a more reliable coupling than is experienced with prior art connectors.

A second connector 10 of an opposing cross runner 11 can be assembled in a hole 13 from the side opposite the first connector. A second connector 10 is placed laterally against the lead end of the first connector and pushed into the center hole slot 52 until its abutment edges 48 and 49 contact the web 15 of the main runner 12. In this position, the connectors 10 establish a strong connector-to-connector lock with the forward band 31 of each connector captured in the pocket between opposing projections 26, 27 of the other connector. The locking tab 41 of the second connector 11 works as previously described. The lateral compression on both locking tabs 41, developed by their confinement in the hole 13, serves to maintain the connectors in mutual inter-engagement.

The connector 10 can be easily released from a hole 13 without tools whether or not coupled to an opposing connector. This release is accomplished by holding the main runner 12 in one hand, raising the cross runner to be released so that the top edge of the hole 13 is fully received in the cantilever notch 46 on the top of the associated connector 10 and then twisting the cross runner 11 so that the connector pivots in the hole 13 away from any opposed connector. This pivoting motion moves the connector 10 towards the hole side 56 compressing the associated tab 41. The convex character of the hole side 56 focuses the reaction force developed by the hole side on the trailing portion of the tab 41. The tab 41 is forced towards the plane of the main body of the connector 10 until the locking edge 43 is free of the main runner web area at the edge of the hole 13. In this orientation of the connector 10, the locking strips or bands 31 of any opposed connectors 10 are released from the restriction of opposing projections 26, 27. The twisted connector 10 can now be withdrawn from the hole 13 to release its cross runner 11. No damage or permanent deformation is incurred either by the connector 10 or the main runner 12. The connector 10 can, therefore, be reassembled and disassembled repeatedly.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A sheet metal connector for a suspended ceiling cross runner, the connector comprising elements to interlock with an identical connector when both the connector and an identical connector are assembled from opposite sides of a main runner in a common hole and are in lateral abutment, the connector having a laterally extending resilient tab bent at a line out of a plane of a main part of the connector, the tab extending outwardly and rearwardly from said bend line, the tab having a free edge away from the bend line, the tab being configured to grip a side of a main runner opposite the side from which the connector is inserted in the hole to effectuate a connection to the main runner and having a portion proportioned to remain within the hole when the connector is fully assembled in the hole by abutment of a surface element of the connector against the main runner whereby the connection between the connector and main runner formed by the tab has improved tensile strength as a result of the tab portion preventing the tab from over-bending, wherein the tab is arranged to be resiliently bent back towards the plane of the main body of the connector by an edge of the hole when the cross runner associated with the connector is twisted along its longitudinal axis so as to release the connection formed by the tab with the main runner.

2. A connector as set forth in claim 1, wherein the bend line of the tab is tilted forwardly from a vertical axis.

3. A connector as set forth in claim 1, wherein a free edge of the tab has a step whereby a part of the tab on one side of the step is proportioned to pass through the hole of the main runner and a part of the tab on another side of the step remains in or it cannot enter the hole.

4. A connector as set forth in claim 3, wherein the part of the tab free edge that passes through the hole is tilted forwardly from a vertical axis whereby spring back of the tab causes the free edge to draw the connector tight against the main runner.

5. In combination in a suspended ceiling grid, a main runner comprising a generally A-shaped hole for receiving end connectors of cross runners from opposite sides of the main runner, identical cross runner end connectors having formations to effectuate a connector-to-connector lock when forward ends of the connectors are assembled through the generally A-shaped hole from opposite sides of the main runner, the end connector having a resilient locking tab bent out of a plane of a body of the end connector, the tab being configured to lock an associated cross runner to the main runner when the end connector is inserted in the hole and a surface element of the end connector abuts the main runner to stop further insertion, and to be deflected by an edge of the hole when the associated cross runner and end connector are twisted about a longitudinal axis to release the lock of the tab with the main runner.

6. The combination set forth in claim 5, wherein a lower part of the hole has a central notch bounded by a pair of abutments, the connector having a notch in an upper edge thereof, said connectors being adapted to be initially assembled in the hole by placement of a lower edge thereof in the hole central notch, the connectors being obstructed by the abutments from being twisted in the hole unless a connector is lifted to a position where an upper edge of the hole is in the upper edge notch of the connector.

7. The combination as set forth in claim 5, wherein the sides of the generally A-shaped holes are convex such that the sides bear against the tabs of the connectors when the connectors are twisted for their release from the hole.

* * * * *